US007650913B2

(12) United States Patent
Krumm et al.

(10) Patent No.: US 7,650,913 B2
(45) Date of Patent: Jan. 26, 2010

(54) METHOD AND DEVICE FOR MAINTAINING A WEFT THREAD WHICH IS INTRODUCED INTO A WEAVING MACHINE, IN PARTICULAR AN AIR-JET WEAVING MACHINE, AFTER THE STARTING PROCESS

(75) Inventors: Valentin Krumm, Hergensweiler (DE); Wolfgang Metzler, Ravensburg (DE); Dieter Teufel, Langenargen (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 144 days.

(21) Appl. No.: 11/920,791

(22) PCT Filed: May 17, 2006

(86) PCT No.: PCT/DE2006/000843

§ 371 (c)(1),
(2), (4) Date: Nov. 19, 2007

(87) PCT Pub. No.: WO2006/122531

PCT Pub. Date: Nov. 23, 2006

(65) Prior Publication Data

US 2009/0120527 A1 May 14, 2009

(30) Foreign Application Priority Data

May 19, 2005 (DE) ..... 10 2005 022 955

(51) Int. Cl.

| | |
|---|---|
| ***D03D 45/50*** | (2006.01) |
| ***D03D 45/54*** | (2006.01) |
| ***D03D 45/56*** | (2006.01) |
| *D03D 23/00* | (2006.01) |
| *D03D 47/44* | (2006.01) |

(52) U.S. Cl. ..... 139/450; 139/435.1; 139/117; 139/432; 139/452

(58) Field of Classification Search ..... 139/1 R, 139/116.1, 117, 435.1, 435.2, 435.3, 435.4, 139/435.5, 435.6, 450, 452, 453
See application file for complete search history.

(56) References Cited

U.S. PATENT DOCUMENTS

| | | | | |
|---|---|---|---|---|
| 4,384,598 | A * | 5/1983 | Haussler | 139/446 |
| 4,421,141 | A | 12/1983 | Brouwer | |
| 4,546,803 | A * | 10/1985 | Dornier | 139/449 |
| 4,553,571 | A * | 11/1985 | Gehring et al. | 139/446 |

(Continued)

FOREIGN PATENT DOCUMENTS

| | | |
|---|---|---|
| DE | 198 02 254 | 8/1999 |

(Continued)

*Primary Examiner*—Bobby H Muromoto, Jr.
(74) *Attorney, Agent, or Firm*—W. F. Fasse; W. G. Fasse

(57) ABSTRACT

A weaving machine starts-up in slow speed operation during a first weaving cycle following the machine start. To help avoid weft breaks, a method is provided to hold a weft thread inserted into the loom shed during the first weaving cycle. A sensor monitors the weft insertion. The inserted weft thread is held by binding threads at a location downstream from an inlet side of the loom shed, before the weft thread is bound by the warp threads. The binding of the weft thread by the binding threads is carried out dependent on a signal of the sensor.

14 Claims, 2 Drawing Sheets

U.S. PATENT DOCUMENTS

| | | | | |
|---|---|---|---|---|
| 5,038,835 | A * | 8/1991 | Breyer | 139/1 R |
| 5,224,521 | A | 7/1993 | De Jager | |
| 5,458,160 | A * | 10/1995 | Geiger et al. | 139/25 |
| 5,518,039 | A | 5/1996 | Haeussler et al. | |
| 5,722,464 | A * | 3/1998 | Truyen et al. | 139/25 |
| 5,996,647 | A | 12/1999 | Krumm | |
| 6,082,413 | A | 7/2000 | Scorl et al. | |
| 6,082,654 | A * | 7/2000 | Tholander et al. | 242/365.4 |
| 6,135,162 | A * | 10/2000 | Dornier et al. | 139/110 |
| 6,257,284 | B1 * | 7/2001 | Schuster | 139/194 |
| 6,367,511 | B2 * | 4/2002 | Wahhoud et al. | 139/25 |
| 6,390,144 | B2 * | 5/2002 | Wahhoud et al. | 139/25 |
| 6,439,271 | B2 * | 8/2002 | Schiller et al. | 139/435.2 |
| 6,948,532 | B2 * | 9/2005 | Berktold | 139/452 |
| 7,195,039 | B2 * | 3/2007 | Schaich et al. | 139/274 |
| 2002/0005224 | A1 * | 1/2002 | Schiller et al. | 139/435.1 |
| 2002/0148524 | A1 * | 10/2002 | Christe | 139/50 |
| 2003/0192614 | A1 * | 10/2003 | Berktold | 139/435.1 |
| 2004/0133297 | A1 * | 7/2004 | Vergote et al. | 700/140 |
| 2005/0034775 | A1 * | 2/2005 | Schaich et al. | 139/435.1 |
| 2006/0144457 | A1 * | 7/2006 | Vergote et al. | 139/1 B |
| 2006/0207674 | A1 * | 9/2006 | Sampers | 139/1 E |
| 2009/0120527 | A1 * | 5/2009 | Krumm et al. | 139/437 |

FOREIGN PATENT DOCUMENTS

| | | |
|---|---|---|
| DE | 198 10 129 | 9/1999 |
| EP | 0 511 939 | 11/1992 |
| EP | 0 674 031 | 9/1995 |
| EP | 0 878 570 | 11/1998 |
| EP | 0 942 082 | 9/1999 |
| WO | WO 2005/012609 | 2/2005 |

* cited by examiner

METHOD AND DEVICE FOR MAINTAINING A WEFT THREAD WHICH IS INTRODUCED INTO A WEAVING MACHINE, IN PARTICULAR AN AIR-JET WEAVING MACHINE, AFTER THE STARTING PROCESS

TITLE OF THE INVENTION

Method and Device for Maintaining a weft Tread Which is Introduced into a Weaving Machine, in Particular an Air-Jet Weaving Machine, after the Starting Process

FIELD OF THE INVENTION

The invention relates to a method for holding a weft thread that is inserted into the loom shed within the first weaving cycle after a stating process of a weaving machine, especially an air-jet weaving machine.

BACKGROUND INFORMATION

In that regard, the insertion of the weft thread is monitored by at least one sensor. After each starting process, during at least the first weaving cycle, the weaving machine is operated in slow speed running.

The at least first inserted weft thread is held against springing back into the loom shed at the outlet side of the loom shed at least until the interlacing or binding thereof by warp threads.

Several weft thread detecting and stretching apparatuses are already known, for example from the DE 198 02 254 C1 and the DE 198 10 129 B4. However, these documents do not pertain to the behavior of weft yarns during the weft insertion in various different rotational speed ranges of the weaving machine, for example at a new start of the weaving machine.

In the production of selected woven webs or fabrics, such as for example jeans fabrics and fabrics with a twill weave or binding on air-jet weaving machines, it has been found to be advantageous, especially with respect to achieving a woven ware without start-up marks, after each start of the weaving machine, the first weaving cycle, namely with reference to the rotational angle of the main drive shaft, to operate or drive the first full rotation of the main drive shaft in the slow speed running, namely with less than 200 $min^{-1}$. The above described technology in the operation of air-jet weaving machines is known for a long time under the term "single weft or shot automatic". In an air-jet weaving machine, the process of the weft thread insertion itself is not concerned or affected by the slow speed running; the weft thread insertion occurs in consideration of the time duration necessary therefor in such a manner as if the air-jet weaving machine would already operate with a predetermined operating rotational speed directly after the starting process.

The weft thread that is thus inserted in a time of a few milliseconds across the weaving width into the loom shed is to be held by suitable means at the outlet side of the loom shed, thus on the side of the loom shed lying opposite the weft thread insertion, for so long until it is beat-up against the woven web edge by the weaving reed and is interlaced or bound by the shed-forming warp threads. In air-jet weaving machines, the inserted weft thread is held on the outlet extraction side of the loom shed in a known manner by pneumatically acting stretching or sucking nozzles. In the processing of weft yarns with relatively low ripping or tearing strength it can be determined, that during the weaving cycle directly following the start of the weaving machine, in which the weaving machine is operated in the slow speed running, the applicable weft thread is impaired under the effect of the holding means in such a manner that a weft thread break arises before the binding of the weft thread by the warp threads. In such a case, the part of the weft thread remaining on the insertion side "springs" back into the loom shed that is not yet completely closed, and thereby produces a defect in the woven web or fabric.

SUMMARY OF THE INVENTION

Therefore the object underlies the invention, to be able to process even weft yarns having a low tearing force without problems on weaving machines, especially air-jet weaving machines, which are operated in a slow speed running in the first weaving cycle after a weaving machine start.

The object is achieved according to the invention in that the weft thread inserted into the loom shed is bound by separate binding threads temporally before the binding by the warp threads, and in that the binding with the binding threads occurs spatially at least one position of the loom shed after its inlet.

Known, individually controllable selvage and leno arrangements as well as fabric selvage or catch selvage apparatuses can be used for the binding of the weft thread.

In the use of known leno arrangements, for example so called rotational leno selvage former as these are known from EP 0 674 031 B2, the electric motor driven rotational leno selvage former, which guides the separate binding threads, receives an electrical signal from the sensor monitoring the insertion of the weft thread into the loom shed. Thereupon at least the one rotational leno selvage former will bind the inserted weft thread by means of the at least two binding threads temporally before the binding by the warp threads. By a multiple arrangement of such rotational leno selvage formers provided over the weaving width of the woven web or fabric to be produced, the inserted weft thread can be bound several times over its length, thus at several different positions over the weaving width, in the not-closed loom shed. With the multiple binding of the weft thread it is achieved in an advantageous manner that the stretching force of the stretching or sucking nozzle effective on the inserted weft thread can be reduced in a differentiated manner, and during the slow speed running of the weaving machine, weft thread breaks can be avoided even in the processing of weft yarns having a low tearing force. In a further embodiment of the inventive method, the electrical signal necessary for actuating the leno arrangements multiply arranged over the weaving width can be triggered by a sensor of the weft accumulators or weft storage devices allocated to every air-jet weaving machine, and particularly dependent on a number of windings of the weft thread reserve held ready on the weft storage devices, whereby the number of windings is predeterminable on each weft thread storage device. It is further conceivable that the necessary signal is triggered by a sensor that monitors the arrival of the weft thread at the outlet side of the loom shed. In the latter case, the binding of the inserted weft thread by the binding threads guided by the leno arrangements would occur simultaneously. Upon the triggering of at least one first signal from the applicable sensor of the weft storage device and by further subsequent signal formation, the weft thread can be bound temporally one after another in the direction of the outlet of the loom shed by further such binding threads guiding leno arrangements.

For carrying out the method on an air-jet weaving machine, the use of known, individually controllable selvage and leno arrangements and the use of controlled fabric selvage and catch selvage apparatuses is provided. The electrical actuation of the drive of the individually controllable selvage and leno arrangements occurs by means of an electrical signal that is given off by at least one sensor that monitors the weft thread insertion.

Such a sensor is a component of each or every weft storage device which holds ready a weft thread reserve for the weft thread insertion into the loom shed of the air-jet weaving machine. Such a sensor can also be a component of the weft stop motion arranged on the outlet of the loom shed. In further embodiment of the invention, the sensor can also be arranged in the area of the insertion path lying between the weft thread storage device and the weft stop motion, and can be embodied as a length measuring sensor.

With the inventive solution it is now possible for the first time in advantageous manner, on weaving machines, especially air-jet weaving machines, which are operated in the slow speed running in the respective first weaving cycle after a machine start, to bind by binding threads the weft thread that was inserted during the first weaving cycle, temporally before its binding by the warp threads at selectable positions between the inlet and outlet of the loom shed. Thereby, a weft thread break with the result of the weft thread springing back into the loom shed can be largely or substantially prevented.

BRIEF DESCRIPTION OF THE DRAWINGS

In the following, the invention will be explained in more detail in connection with an example embodiment.

In the drawings.

DETAILED DESCRIPTION OF AN EXAMPLE EMBODIMENT OF THE INVENTION

Figure 1:
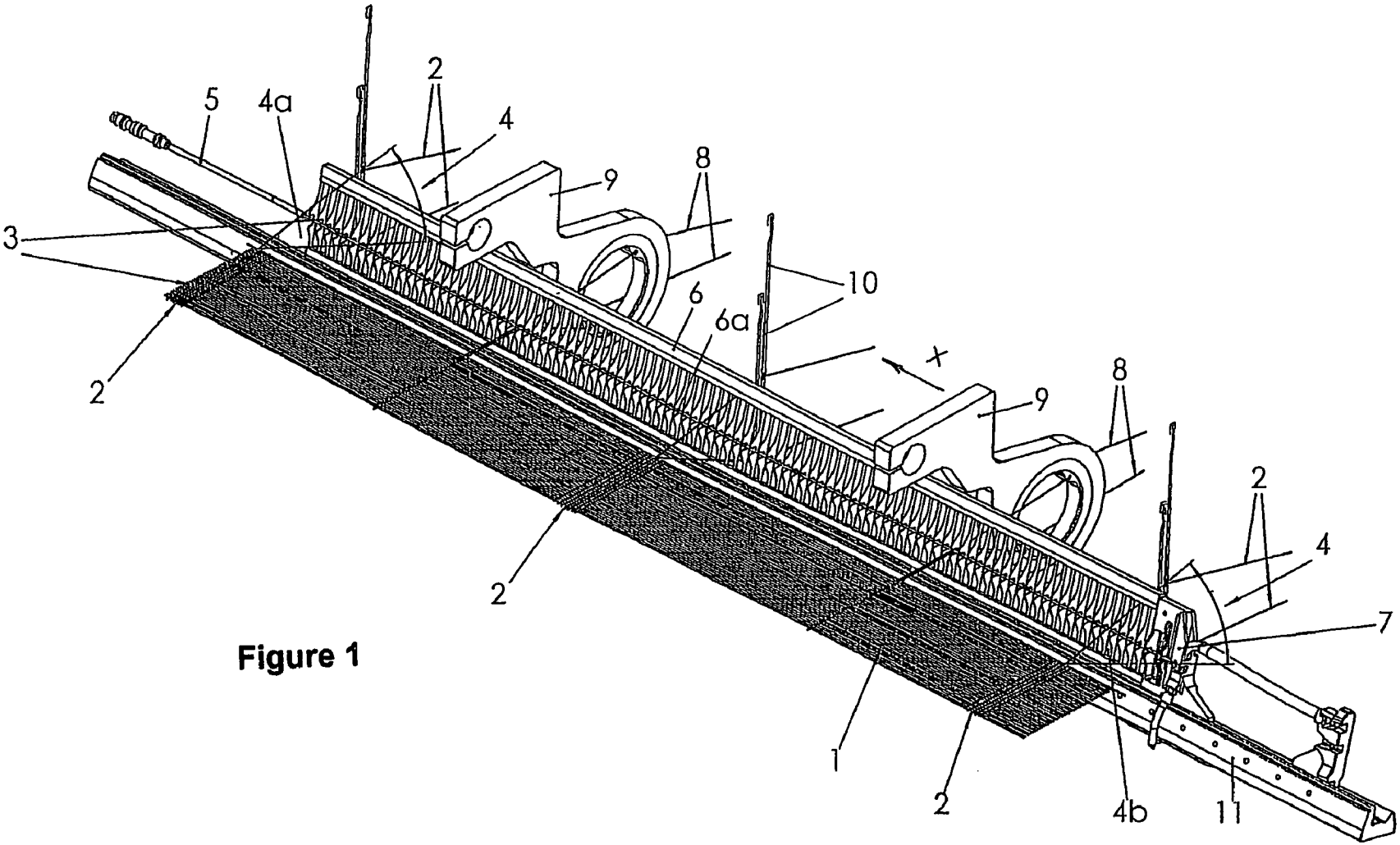
FIG. 1 shows a functional unit of an air-jet weaving machine with means for inserting a weft thread in the loom shed, with means for detecting the weft thread at the outlet side of the loom shed, and with means for binding the weft thread in a position between the inlet and outlet of the loom shed.

A woven web or fabric 1 to be produced on an air-jet weaving machine in FIG. 1 consists of warp threads 2 and weft threads 3. The warp threads 2 form a loom shed 4 by shed forming means 10. The weft thread 3 is inserted into the loom shed 4 by means of at least one weft thread insertion means 5 into the weft thread insertion channel 6*a*, also see FIG. 2, of a weaving reed 6 and thus into the loom shed 4. On the outlet side of the loom shed 4, a length section of the weft thread 3 is held stretched by a pneumatically effective weft thread stretching arrangement 7 up to the time point of the beating-up of the weft thread by the weaving reed 6 against the beat-up edge 1*a* of the woven web 1 and until the binding thereof by the warp threads 2. In air-jet weaving machines, which are operated in a slow speed running in the first weaving cycle after a weaving machine stop in consideration of the avoidance of a so-called start-up mark in the fabric, the tension force exerted on the weft thread by a pneumatically acting stretching arrangement 7 can lead to a weft thread break as long as the weft thread is not bound by the warp threads 2. Undesired interruptions of the weaving process are the results. With the binding of the mentioned weft thread 3 by binding threads 8 at one or more suitable positions between the inlet 4*a* and outlet 4*b* of the loom shed 4, the applicable weft thread can be held until its beating-up against the beat-up edge of the woven web 1 and until its binding by the warp threads 2. For carrying out this method of proceeding, as shown in FIG. 1, a leno arrangement that is per se known and used as a binding arrangement 9 is arranged at a suitable position in the area of the warp threads 2, whereby the means of the leno arrangement guiding the binding threads 8 are connected with an individually controllable electric motor drive.

Figure 2:
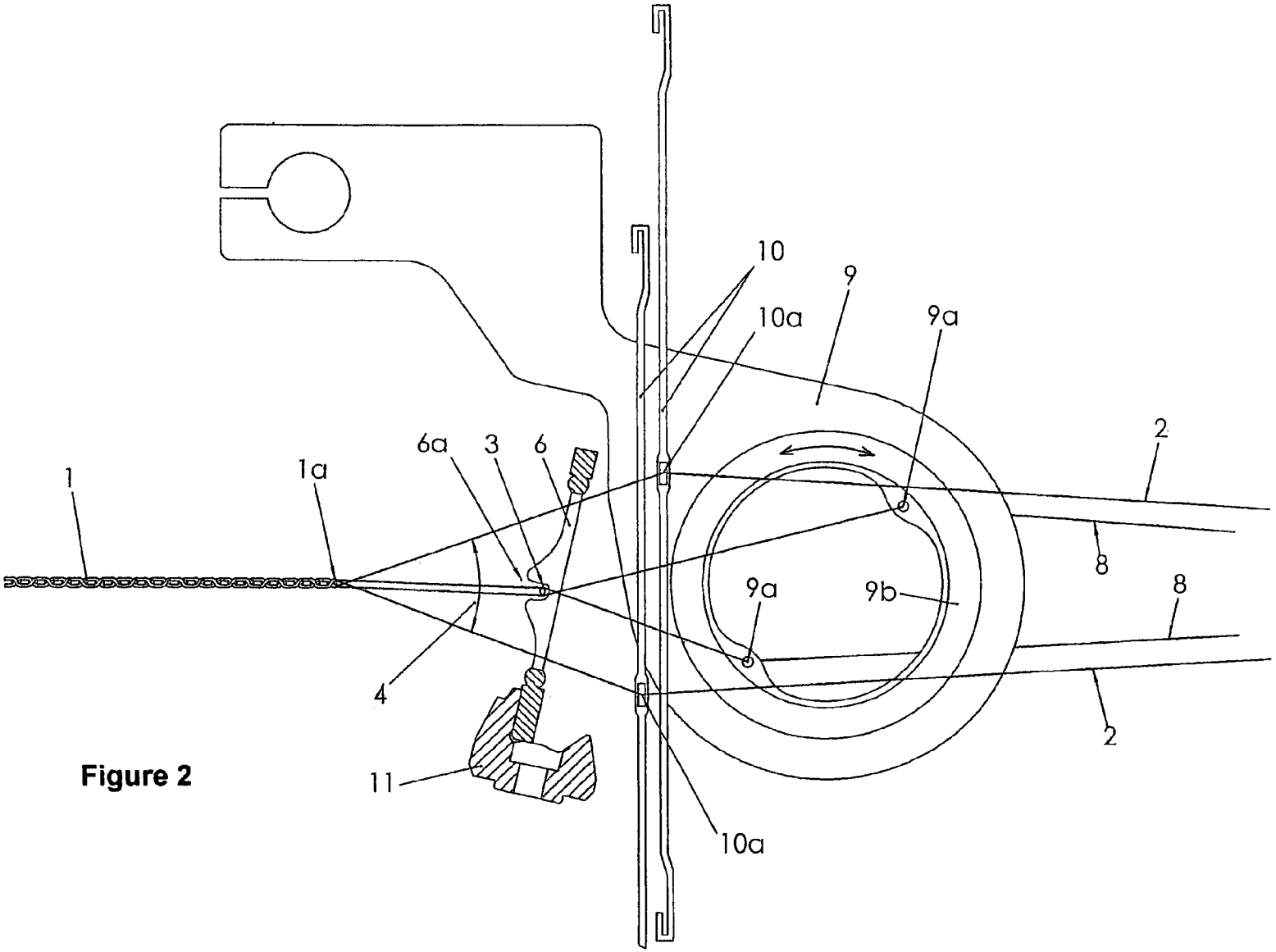
FIG. 2 shows a view X according to FIG. 1 with a weft thread bound by binding threads, with opened loom shed.

FIG. 2 shows the binding arrangement 9 in the area of the warp threads 2. For forming the loom shed 4, the warp threads 2 are guided through eyelets 10*a* of heddles 10. The heddles 10 in that regard can be such ones of harness cords of a jacquard arrangement or such ones of held shafts. The weaving reed 6 taken up in the so-called weaving reed support 11 has a weft thread insertion channel 6*a*. With an opened loom shed 4, the weft thread 3 is inserted into the weft thread insertion channel 6*a* of the weaving reed 6. The arrangement 9, for example the rotational leno selvage former that is controllable and constructed accorded to the European Patent 0 674 031 B2, guides binding threads 8 in the manner of warp threads 2. The electric motor drive of the arrangement 9 receives an electrical signal at the earliest possible time point after the insertion of the weft thread and during the slow speed running of the weaving machine, for example from a sensor that is not illustrated here and that monitors the insertion of the weft thread 3. Due to a half rotation of the leno disc 9*b* guiding the binding threads 8 in eyelets 9*a*, for example on the basis of this signal, a binding of the weft thread 3 is achieved before the weft thread that is inserted during the slow speed running of the weaving machine is beat-up against the beat-up edge 1*a* of the woven web 1 and bound by the warp threads 2.

The invention claimed is:

1. Method of operating a weaving machine, especially an air-jet weaving machine, to produce a woven fabric, said method comprising starting the weaving machine in a starting process, operating the weaving machine in a slow speed running after the starting process during at least a first weaving cycle, inserting a weft thread during the first weaving cycle, monitoring the insertion of the weft thread by at least one sensor and correspondingly producing a signal, holding the inserted weft thread at the outlet side of the loom shed against springing back into the loom shed at least until binding thereof by warp threads, wherein said holding of the inserted weft thread comprises binding the inserted weft thread by separate binding threads temporally before the binding by the warp threads, wherein the binding by the binding threads is carried out spatially at at least one position of the loom shed after the inlet side of the loom shed, and wherein the binding by the separate binding threads is carried out dependent on the signal of the at least one sensor monitoring the insertion of the weft thread.

2. Method according to claim 1, comprising triggering the signal upon the presence of a predeterminable number of windings of a weft thread reserve of the weft thread held ready on a weft thread storage device of the weaving machine.

3. Method according to claim 1, comprising triggering the signal upon the arrival of the weft thread at the outlet side of the loom shed.

4. Method according to claim 1, comprising carrying out the binding of the weft thread by the binding threads respectively at plural positions over the weaving width that is to be produced.

5. Method according to claim 4, comprising carrying out the binding of the weft thread by the binding threads simultaneously at the plural positions.

6. Method according to claim 4, comprising carrying out the binding of the weft thread by the binding threads successively at the plural positions one after another in the direction of the weft thread insertion.

7. A method of operating a weaving machine, comprising the steps:

a) starting said weaving machine from a stop at a machine start time, and operating said weaving machine in a slow speed running operation during a first weaving cycle following said machine start time;

b) forming an open loom shed of warp threads with said weaving machine during said first weaving cycle;

c) inserting a weft thread into said open loom shed across said warp threads and progressing downstream from an inlet side to an outlet side of said loom shed during said first weaving cycle;

d) monitoring said inserting of said weft thread with a sensor of said weaving machine, and providing a signal indicative of said monitoring by said sensor;

e) after said step c) during said first weaving cycle, holding said weft thread by binding said weft thread with binding threads at at least one location downstream from said inlet side of said loom shed, wherein said binding of said weft thread with said binding threads is carried out dependent on said signal indicative of said monitoring by said sensor; and f) binding said weft thread with said warp threads by closing said loom shed after said binding of said weft thread with said binding threads, while maintaining said holding of said weft thread at least until said binding of said weft thread with said warp threads.

8. The method according to claim 7, wherein said weaving machine is an air-jet weaving machine, and said step of inserting said weft thread uses an air-jet to insert said weft thread.

9. The method according to claim 7, wherein said at least one location of said holding of said weft thread comprises a location at said outlet side of said loom shed, and said holding of said weft thread holds said weft thread against springing back into said loom shed toward said inlet side until said binding is carried out in said step f).

10. The method according to claim 7, wherein said weaving machine includes a weft thread storage device which holds ready a weft thread reserve of said weft thread for said step c), and wherein said providing of said signal in said step d) comprises triggering said signal when said sensor senses the presence of a predetermined number of weft thread windings of said weft thread in said weft thread reserve.

11. The method according to claim 7, wherein said sensor is a weft thread sensor arranged at said outlet side of said loom shed, and said providing of said signal in said step d) comprises triggering said signal when said weft thread sensor senses the arrival of said weft thread at said outlet side of said loom shed.

12. The method according to claim 7, wherein said at least one location comprises plural locations dispersed across a weaving width from said inlet side to said outlet side of said loom shed, and said binding of said weft thread with said binding threads for said holding of said weft thread is carried out respectively at each one of said plural locations.

13. The method according to claim 12, wherein said binding of said weft thread with said binding threads is carried out simultaneously at all of said plural locations.

14. The method according to claim 12, wherein said binding of said weft thread with said binding threads is carried out successively one after another respectively at said plural locations progressing downstream from said inlet side to said outlet side.

* * * * *